United States Patent [19]

Neumaier et al.

[11] Patent Number: 4,898,250

[45] Date of Patent: Feb. 6, 1990

[54] HAND-HELD TOOL WITH SWITCHING MEANS FOR VARIABLE OPERATION

[75] Inventors: Anton Neumaier, Senserbergstr.; Uto Plank, Albert-Sigismund-Str.; Gerhard Rumpp, Schornstr., all of Fed. Rep. of Germany

[73] Assignee: Hilti Aktiengesellschaft, Fürstentum, Liechtenstein

[21] Appl. No.: 134,516

[22] Filed: Dec. 17, 1987

[30] Foreign Application Priority Data

Dec. 17, 1986 [DE] Fed. Rep. of Germany ..... 3642976

[51] Int. Cl.[4] ..... E02D 7/02

[52] U.S. Cl. ..... 173/48; 173/104; 173/109

[58] Field of Search ..... 173/48, 104, 109

[56] References Cited

U.S. PATENT DOCUMENTS 4,502,824 3/1985 Dohse et al. ..... 173/48 X 4,585,077 4/1986 Bergler ..... 173/48 X 4,703,942 11/1987 Rohn ..... 173/48 X 4,750,567 6/1988 Grossman et al. ..... 173/48 X

*Primary Examiner*—Douglas D. Watts

*Assistant Examiner*—William Fridie, Jr.

*Attorney, Agent, or Firm*—Toren, McGeady & Associates

[57] ABSTRACT

In a hand-held tool having a tool holder for receiving a variety of tool bits, a probing device is provided for checking the surface configuration of the shank of a tool bit inserted into the tool holder. The probing device includes at least one control element arranged to move radially inwardly through an opening in the tool holder. If the control element moves radially inwardly into an axially elongated recess in the tool bit shank, it moves out of stopping engagement with a slide permitting the slide to move relative to the control element and initiating a switching operation for changing the driving action of the hand-held tool.

27 Claims, 2 Drawing Sheets

HAND-HELD TOOL WITH SWITCHING MEANS FOR VARIABLE OPERATION

BACKGROUND OF THE INVENTION

The present invention is directed to a hand-held tool with a holder for tool bits and a probing device for checking the surface configuration of the tool bit for effecting a switching procedure of the tool operation.

An electrically driven hand-held tool in the form of a drill is disclosed in DE-OS 29 43 508 and carries out a switching operation controlled by the surface configuration of inserted tool bits with the switching procedure providing the appropriate operation of the tool. The surface configuration of the tool bit is determined mechanically by a probing device including a displaceable pin, which effects the variable displacement of the probing device. An electrical regulator is adjusted by the probing device in accordance with the displacement travel and, in turn, switches the drive of the hand-held tool to the desired value.

The surface contour of the tool bit which determines the desired operation is located at the forward region of a threaded sleeve extending in the insertion direction of the tool bits. The threaded sleeve is bolted to an adapter in which a bit is clamped. The tool parts consisting of the threaded sleeve, the adapter and drill bit are retained in the tool holder of the hand-held tool so as to be exchangeable by a rapid action lock. The threaded sleeve is moved into an appropriate axial position relative to the adapter before the tool bit is inserted into the holder for determining the desired tool operation.

Such tool bit dependent control is not suitable for hand-held tools, such as hammer drills, which direct axial blows against the tool bit, since such blows result in an intermittent axial movement of the tool bits. The axial movement of the tool bits would be transferred to the probing device and would render the control of the tool operation impossible.

SUMMARY OF THE INVENTION

Therefore, the primary object of the present invention is to provide a hand-held tool with a probing device for effecting the operation of the hand-held tool dependent on the tool bit inserted into the tool holder for use in a hand-held tool where blows are directed against the tool bit.

In accordance with the present invention, the probing device includes a slide displaceable in the direction of the tool bit axis and at least one control element displaceable essentially transversely of the tool bit axis into a guide bore in the tool holder. If the control element is displaced out of the guide bore by the surface configuration of the tool bit, the slide abuts against the control element, however, if the control element is displaced into the guide bore, then the slide can move over and past the control element. By dividing the probing device into the slide and at least one control element, which is displaceable essentially transversely of the tool bit axis into the guide bore of the tool holder and also transversely of the displacement direction of the sleeve, the surface configuration of the tool shank inserted into the holder can be checked and used for switching the operation of the hand-held tool. The surface configuration to be probed or checked can extend along the axial direction of the tool bit shank. Axial movement of the tool bits does not influence the probing position of the control element. Accordingly, the probing device is suited for use with hand-held tools which exert axially directed blows against the tool bit.

If a tool bit is inserted into the tool bit holder, its surface contour permits the displacement of the control element into the guide bore and removes the stop action for the slide, whereby the slide can move over and past the control element. Such movement or travel of the slide is used for initiating a switching operation, such as, for effecting another transmission ratio of the tool or changing the number of blows directed against the bit. On the other hand, when a tool bit is inserted into the holder, if its surface contour or configuration retains the control element outwardly out of the guide bore, the control element retains its function as a stop for the displacement of the slide. As a result, the operation of the tool is not switched and a standard operation of the tool for such a condition is transmitted to the tool bit.

Preferably, several control elements are used so that several different switching operations can be performed with the control element being displaceable at axially spaced locations into the guide bore of the tool holder. Based on the number of control elements, the surface configuration of the shank of the tool bits inserted into the tool holder can be provided with a corresponding number of axially elongated grooves, a lesser number of such grooves, or no grooves at all.

For simplicity, the control elements are in the form of balls and are supported in radially extending openings in the tool holder. The diameter of the balls is selected so that it exceeds the radially directed wall thickness of the sleeve-shaped tool holder. Accordingly, the balls necessarily project radially outwardly from the outer surface of the holder or extend radially inwardly into the guide bore formed within the holder.

In one preferred embodiment, the control elements are arranged offset relative to one another in the circumferential direction of the tool bit holder. As a result, an axially stepped leading end of the slide serves to contact a radially outwardly displaced locking or control member, whereby different axial positions of the slide for controlling the switching operation can be attained, based on the radial position of the control elements. Accordingly, a different axial step on the forward region of the slide is assigned to each control element.

In another embodiment of the invention, the control elements are arranged offset relative to one another in the axial direction of the tool bit holder. This arrangement of the control elements affords an axially unstepped and thus simple construction of the leading region of the slide. Depending upon the radial position of the control elements, the slide can move into the appropriate axial position for initiating the corresponding switching operation. Furthermore, the axially offset arrangement of the control elements can be combined with the arrangement of the control elements offset in the circumferential direction, so that the combination enables additional switching positions.

The slide is constructed advantageously as a sleeve encircling the tool bit holder. The circumferentially extending leading end of the sleeve facing the tool bit abuts or contacts the control element displaced radially outwardly out of engagement within the holder bore.

A spring member biases the slide against the control elements. Depending on the radial position of the control elements, the spring member, preferably a compression spring, automatically biases the sleeve into the axially spaced switching positions. If all of the control elements are displaced radially inwardly into the bore, the sleeve is biased over the control elements and assumes the position corresponding to its maximum displacement travel. The return of the sleeve into the initial position occurs by overcoming the spring force, for instance, by manually displacing the sleeve on the exterior of the tool. The locking of the tool bits is expediently coupled with the displacement of the slide.

The probing device can initiate the switching operation mechanically, optically or electrically. In each instance, the displacement of the slide of the probing device is used as a signal for initiating the switching operation.

For mechanical operation, the probing device includes a switching member or detent for a multistage gear train. The switching member can be formed as a unit with the slide, or it can be in the form of a separate switching rod operating with the slide. The switching member can be designed as a driving key for selectively coupling different drive wheels with the tool bit holder for the transmission of variable rotary movement.

For the electrical initiation of the switching operation, the probing device in another embodiment includes an induction core coacting with a sensor for producing inductive switching signals. The induction core is formed as a unit with the slide and in at least one axial position of the slide is located within the induction range of the sensor. The induction core is formed of sections of different volume arranged in series in the displacement direction of the slide for effecting several different switching steps. The sections of different volume can be spaced at different distances from the sensor with or without steps. Depending upon the initial position of the slide, the sensor supplies different electrical signals through the effect of the induction core and preferably such signals indirectly effect the switching operation. The switching operation can, for instance, be directed to the change of the RPM or the direction of rotation of the tool holder.

The surface configuration or contour of the tool bit shank to be probed by the tool element can be achieved in accordance with another embodiment of the invention with the shank having at least one recess for the control element of the probing device and the recess can be in the form of an axially elongated groove. When the tool bit is inserted into the holder, the axially elongated groove is located within the region of movement of the control element whereby the control element can move radially inwardly into the groove. Such an arrangement eliminates the displacement limit for the slide so that the slide displaces itself and its displacement travel is used in the switching operation of the tool.

If a tool bit without a recess in the form of an axially elongated groove is inserted into the holder, the control element cannot move radially inwardly into the bore in the holder and provides a stop for any displacement of the slide. As a result, the slide does not move axially, yet affords a switching operation of the tool.

The recess in the form of an axially elongated groove has an axial length which is a multiple of the axial extent of the control element within the groove. This feature is particularly effective in avoiding any impairment of the axial movement of the tool bit where the bit receives axially directed blows.

Preferably, several recesses are arranged in the outer circumferential surface of the tool bit shank. The distribution of the recesses, in the form of axially elongated grooves, can be in a uniform or non-uniform manner. In coaction with the slide, comprising an axially stepped front end facing the locking members, different axial positions of the slide can be achieved for initiating the switching operation. In another version of the arrangement of the recesses, the recesses can be arranged axially offset relative to one another. The axially offset feature can be combined with the distribution of the recesses around the circumference of the shank so that in such a combination a large number of switching positions are obtained. With the axial offset of the grooves it is especially understood that the leading and trailing end of adjacent recesses or depressions in the form of axially elongated grooves are located at axially spaced positions, and this is achieved by providing different lengths of the grooves.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
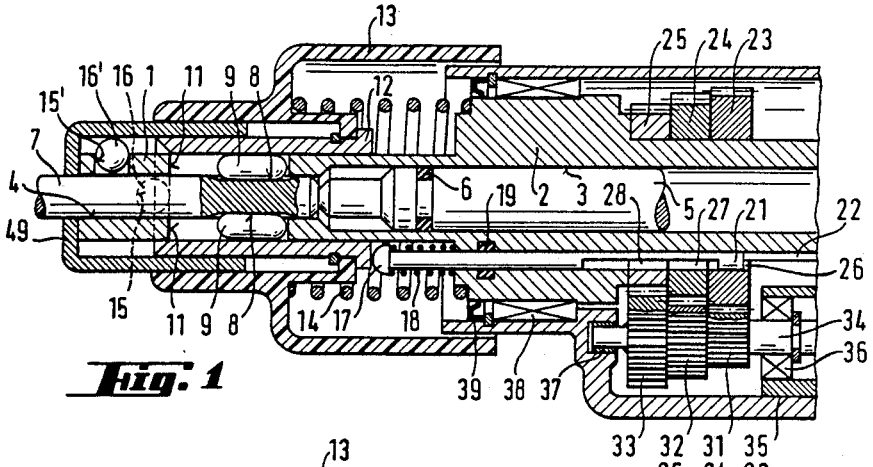
FIG. 1 is the forward section of a hand-held tool, in axial section, embodying the present invention, with a probing device for mechanical initiation of a switching operation and with a tool bit inserted into the leading end of the tool.

The hand-held tools of which the forward axially extending regions are illustrated in FIGS. 1 to 7, are hammer drills in which both rotary movement and impact or percussive blows can be imparted to tool bits secured in the tool. The impact force directed against the tool bit is transmitted to the material being worked on by the bit and for carrying out such work, a limited axial displaceability of the tool bit in the hand-held tool is required. In FIGS. 1 to 4, the hand-held tool or hammer drill has a sleeve-shaped axially extending tool bit holder 1, formed as a unit with a trailing guidance cylinder 2, with the holder and the cylinder being coaxial. Axially extending guidance cylinder 2 is hollow and forms a bore 3, which extends toward the forward end of the tool and opens into a smaller diameter guidance bore 4, extending axially through the tool bit holder 1. A striking member 5 is axially displaceably positioned in the bore 3, and is sealed with the surface of the bore by a ring 6 seated within a circumferentially extending groove in the striking member. The striking member is reciprocated by a drive, not shown, and serves for providing a continuous reciprocating action on the tool bit which may, for instance, by a drill bit with its shank 7 inserted into the bore 4 in the holder 1.

The shank 7 located within the holder 1 has two axially extending entrainment grooves 8 located diametrically opposite one another for retaining the bit with limited axial displaceability and rotational entrainment by means of locking rollers 9, which fit into the grooves 8. In addition, the shank 7 of the tool bit shown inserted in FIG. 1, has a cylindrically-shaped outer surface. Locking rollers 9 are supported in window-like openings 11 of the holder 1 and are retained in the locking position by a sleeve-shaped slide 12, extending concentrically around and in contact with the radially outer surface of the tool bit holder 1.

Figure 2:
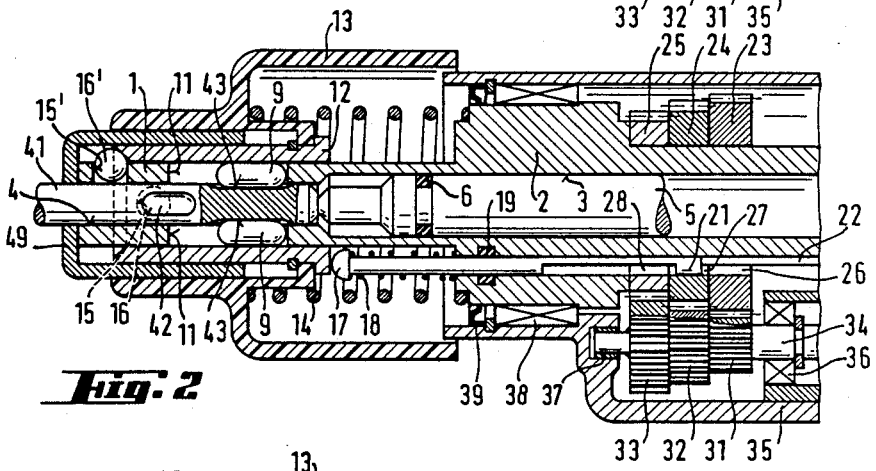
FIG. 2 is an axially extending sectional view, similar to FIG. 1, with the inserted tool bit having a pair of axially elongated grooves to be checked by the probing device.
Figure 3:
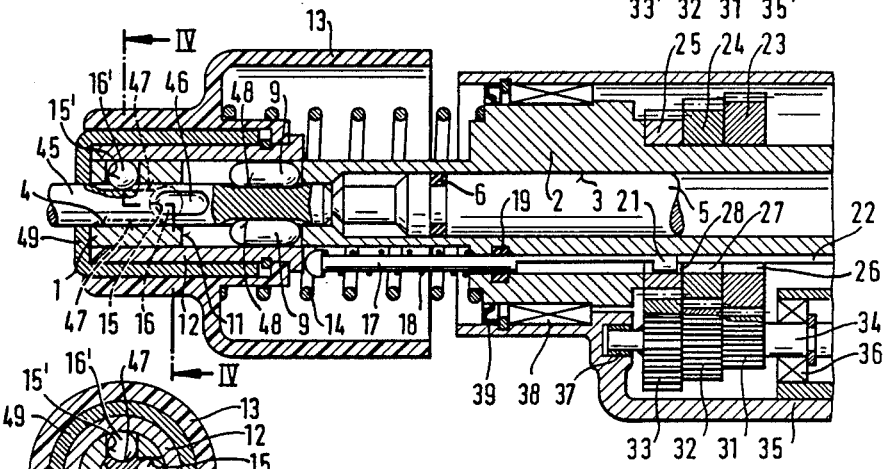
FIG. 3 is a view similar to FIGS. 1 and 2, but with the inserted tool bit having two pairs of axially elongated grooves to be checked or probed by the probing device.

To release the engagement of the locking rollers 9 in the grooves 8, the slide 12 can be moved to the right as viewed in FIGS. 1 to 3 and then rotated, whereby depressions in the inside surface of the slide release the locking rollers radially outwardly in a known manner. The axial displacement of the slide is effected by external manual actuation of a sleeve 13 rigidly connected with the slide 12. A compression spring 14 at one end abuts against an inside surface of the actuation sleeve 13, and at the other end bears against a shoulder on the outer surface of the guide cylinder 2. The biasing action of the compression spring 14 must be overcome to move the actuation sleeve 13 and the slide 12 in the rightward direction.

Figure 4:
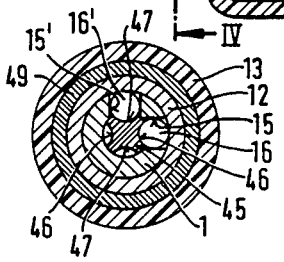
FIG. 4 is a cross-sectional view of the hand-held tool in FIGS. 1 to 3, taken along the line IV—IV in FIG. 3.

Two openings or apertures 15, 15' extend through the holder 1 adjacent its forward end and the openings are spaced apart in the axial direction of the holder and are offset through 90° in the circumferential direction, note FIG. 4. A control element 16, 16' in the form of a ball is supported in each opening 15, 15', respectively. Control elements 16, 16' bear against the outer cylindrically-shaped surface of the shank 7 of the tool bit, as shown in FIG. 1, and project radially outwardly from the radially outer surface of the tool bit holder 1. Accordingly, slide 12 can be axially displaced in the leftward direction by the compression spring 14 only up to the axially rearward control element 16 in FIG. 1, that is, the control element closer to the locking rollers 9. The leading end of the slide 12, that is its left end in FIG. 1, bears against the control element 16 and is shown in broken lines in FIG. 1 for clarification of this control position. The axial movement of the slide 12 is followed by a switching rod 17, maintained in contact with the trailing end of the slide, that is the right-hand end, as viewed in FIG. 1, by another compression spring 18 encircling the forward end of the switching rod. Switching rod 17 is supported in an opening through the wall of the cylinder 2 and is surrounded by a sealing ring 19 seated within a groove encircling the opening in the cylinder 2. The trailing end of the switching rod 17, spaced axially from the slide 12, acts as a switching member 21 in the form of a driving key. Switching member 21 is supported in a radially open groove 22, formed in the guidance cylinder 2, with the switching member bearing against the circumferential surface of the guidance cylinder 2.

Three gear wheels 23, 24, 25, each of a different size are seated on the outside surface of the guidance cylinder 2 and are freely rotatable with each gear wheel having a splined bore section. In dependence on the axial position of the slide, the switching member 21 on the rod 17 moves together with the slide into engagement with a groove 26, 27, 28 of the splined bore sections of the gear wheels 23, 24, 25. In FIG. 1, the switching member 21 is shown in engagement with the groove 26 so that the gear wheel 23 is coupled with the cylinder 2 and the holder 1 in a rotationally locked manner.

Spur pinions 31, 32 33, mesh with the gear wheels 23, 24, 25, and the pinions are seated on a drive shaft 34, so that the pinions rotate with the shaft. With the gear wheel 23 coupled to the guidance cylinder 2, the rotational movement of the spur gear 31 is transmitted to the guidance cylinder 2 and corresponds to the lowest RPM of the cylinder 2. Drive shaft 34 is rotationally supported in the tool housing 35 by means of bearings 36, 37. A roller bearing 38 and a sealing ring 39 serve for the rotational support and sealing of the guidance cylinder 2 within the housing 35 of the tool.

In FIG. 2, a shank 41 of another tool bit is displayed and has a pair of axially elongated grooves spaced axially forwardly of entrainment grooves 43. As viewed in FIG. 2, as the shank is inserted, it first passes the grooves 42 and then enters the region of the entrainment grooves 43. Grooves 42 are arranged diametrically opposite one another for effecting automatic adjustment of the tool RPM suitable for the inserted tool bit. In FIG. 2, only one axially extending groove 42 can be seen. The control element 16, located closer to the locking rollers 9, can move into one of the diametrically opposite axially extending groove 42 in the inserted shank. Such inward movement is aided by the slide 12 acted on by the compression spring 14, so that the slide passes over the control element 16 and contacts the axially adjacent control element 16' projecting radially outwardly from the outside surface of the tool bit holder 1. With the forward movement of the slide 12, switching member 21 of the following switching rod 17, moves into the groove 27 of the middle gear wheel 24, whereby a higher RPM can be transmitted to the guidance cylinder 2, as compared to the RPM transmitted in FIG. 1.

In FIG. 3, a shank 45 of another different tool bit is shown and the shank has two pairs of axially elongated grooves 46, 47 axially offset and displaced through 90° relative to one another, so that both control elements 16, 16' can engage into the grooves, note FIG. 4. In each pair, the grooves are located diametrically opposite one another. The axially extending grooves 46, 47 are located in the region of the shank between the entrainment grooves 48 and the opening into the holder 1. The slide 12 can move axially over the radially inwardly displaced control elements 16, 16' and contact the pot-shaped stop part 49 extending transversely across the forward end of the holder 1. The part 49 is fixed to the holder 1. In the axial position reached when the slide 12 contacts the stop part 49, the switching member 21 couples the gear wheel 25 with the guidance cylinder for providing the highest RPM.

The arrangement of the axially elongated grooves 42, 46, 47 in pairs arranged diametrically opposite one another permit the insertion and locking of the shank 41, 45 in the alternative rotationally spaced locking positions afforded by the probe device.

To change tool bits, the slide is displaced in the insertion direction of the tool bit shanks 7, 41, 45 into the tool by manual operation of the actuation sleeve 13, as described previously. Displacement of the slide releases the control elements 16, 16' for radially outward movement and the control elements reach a switching position, as shown in FIGS. 1 to 4, after a tool bit has been inserted into the holder 1, and the slide has been released for return toward the forward end of the tool.

Figure 5:
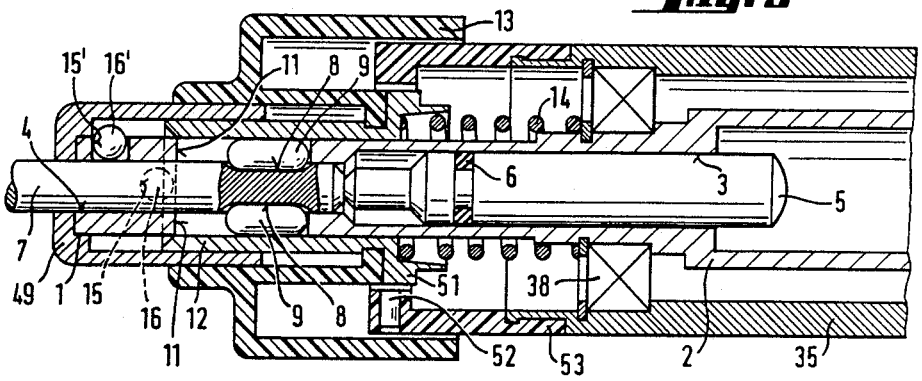
FIG. 5 is a sectional view, similar to FIG. 1, of another embodiment of a hand-held tool incorporating the present invention with a probing device for electrical initiation of a switching operation and with a tool bit inserted into the tool.
Figure 6:
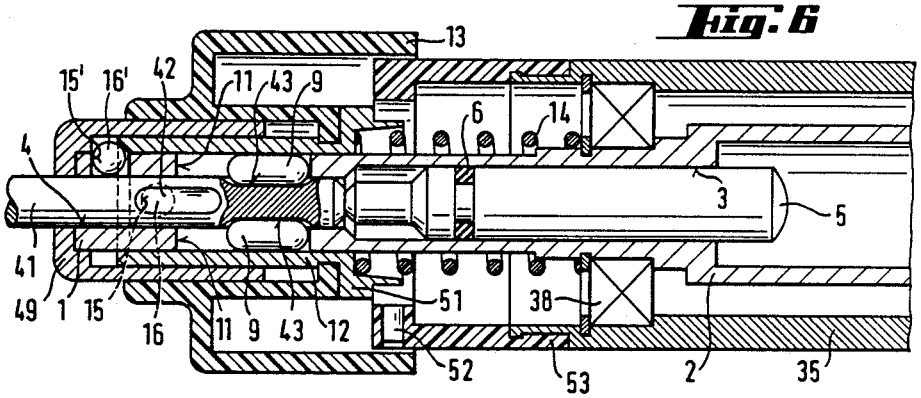
FIG. 6 is a sectional view similar to that in FIG. 5 with the inserted tool bit having a pair of axially elongated grooves to be probed or checked by the probing device.
Figure 7:
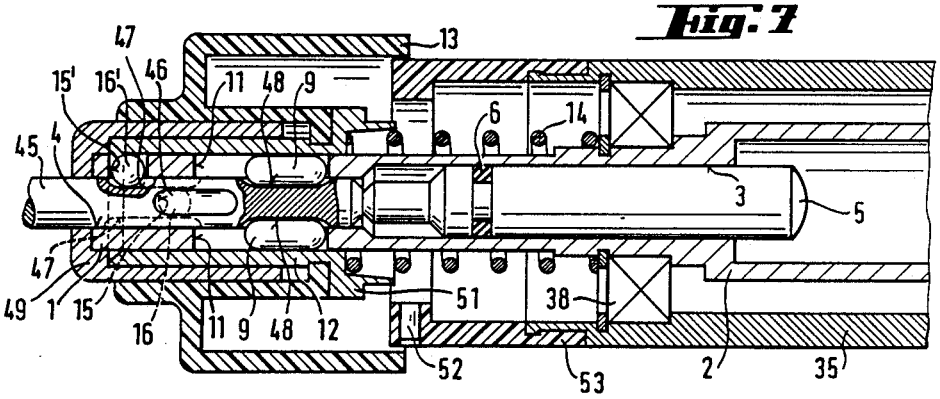
FIG. 7 is a sectional view similar to that in FIGS. 5 and 6 with the inserted tool bit having two pairs of axially elongated grooves to be checked by the probing device.

In the hand-held tool depicted in FIGS. 5 to 7, a hammer drill is shown whose structural arrangement corresponds to the embodiment of the tool in FIGS. 1 to 4. For reasons of simplicity, the structurally and functionally similar tool parts are given the same reference numerals and the previous description of these parts is not repeated.

In FIGS. 5 to 7, the slide 12 includes an induction core 51 at its trailing end, that is, its end more remote from the entrance into the tool holder 1. Induction core 51 is subdivided into axially extending sections, each of a different volume. Further, the different volume sections also have different radial distances from an inductive sensor 52 of a known type. Sensor 52 is retained in an insulating ring 53 fixed to the tool housing 35. Depending on the axially displaced position of the slide 12, which is a function of the contour or outer configuration of the shank 7, 41, 45 of the respective tool bit, a particular section of the induction corp 51 is located above the sensor 52, for instance, the section of larger volume and smaller radial distance (FIG. 5), or the section of smaller volume and larger radial distance (FIG. 6) or the sensor 52 not overlapped by the induction core (FIG. 7). Depending on the relation of the sensor 52 to the induction core 51, magnetic conductivity of the magnetic field built up by the sensor changes and leads to different switching signals in the sensor 52. These variable switching signals are used for carrying out the appropriate switching operation. Accordingly, the RPM, or rotational direction of the drive motor can be controlled. In place of an inductive sensor 52, an optical sensor can be used.

While specific embodiments of the invention have been shown and described in detail to illustrate the application of the inventive principles, it will be understood that the invention may be embodied otherwise without departing from such principles.

We claim:

1. A hand-held tool comprises a housing having a front end through which a tool bit is inserted into an axially extending bore in a tool bit holder for receiving and holding different tool bits within said bore, and a probing means for determining the surface configuration of tool bits inserted into the holder for initiating a switching operation, wherein said probing means comprises at least one control element located within said housing in the region of said holder and being selectively displaceable transversely of the bore axis into the bore, a slide located within said housing coaxial with said bore, said slide arranged to abut against said control element in the axial direction of said bore when the control element is displaced laterally outwardly by a tool bit inserted into said holder and to extend axially over said control element when the control element extends radially inwardly of said slide into said bore, said probing means initiates the switching operation, one of mechanically, electrically or optically, said probing means comprises a switching member for selectively engaging one gear of a multi-stage gear train for the mechanically initiation of the switching operation.

2. A hand-held tool comprises a housing having a front end through which a tool bit is inserted into an axially extending bore in a tool bit holder for receiving and holding different tool bits within said bore, and a probing means for determining the surface configuration of tool bits inserted into the holder for initiating a switching operation, wherein said probing means comprises at least one control element located within said housing in the region of said holder and being selectively dispalceable transversely of the bore axis into the bore, a slide located within said housing coaxial with said bore, said slide arranged to abut against said control element in the axial direction of said bore when the control element is displaced laterally outwardly by a tool bit inserted into said holder and to extend axially over said control element when the control element extends radially inwardly of said slide into said bore, said probing means initiates the switching operation, one of mechanically, electrically for optically, said probing means comprises an induction core in operative engagement with said slide, and co-acting with a sensor for producing inductive switching and signals for electrical initiation of the switching operation.

3. A hand-held tool, as set forth in claim 1, wherein a plurality of said control elements located within said housing in the region of said holder, and arranged to be consecutively displaced into said bore of said holder.

4. A hand-held tool, as set forth in claim 3, wherein said control elements are ball-shaped and are supported in radially extending through openings in said holder.

5. A hand-held tool, as set forth in claim 3, wherein said control elements are offset relative to one another in the circumferential direction of said holder.

6. A hand-held tool, as set forth in claim 3, wherein said control elements are arranged to be offset relative to one another in the axial direction of said holder.

7. A hand-held tool, as set forth in claim 5, wherein said control elements are arranged to be offset relative to one another in the axial direction of said holder.

8. A hand-held tool, as set forth in claim 1, wherein said slide is an axially extending sleeve encircling and in contact with the outside surface of said holder.

9. A hand-held tool, as set forth in claim 1 or 2, wherein a spring element biases said slide into contact with said control element.

10. A hand-held tool, as set forth in claim 8, wherein a spring element biases said slide into contact with said control elements.

11. A hand-held tool, as set forth in claim 1 or 2, including a tool bit for insertion into said holder, said tool bit having an axially extending shank arranged to be inserted into said holder and an axially elongated recess formed in said shank for receiving one control element of said probing means.

12. A hand-held tool, as set forth in claim 1, wherein said axially elongated recess has a length in the axial direction and said control element is ball-shaped and has a diameter less than the axial length of said recess.

13. A hand-held tool, as set forth in claim 11, wherein a plurality of said recesses are arranged spaced circumferentially around said shank.

14. A hand-held tool, as set forth in claim 13, wherein said axially elongated recesses are offset axially relative to the axial direction of said holder with respect to one another.

15. A hand-held tool comprises a housing having a front end through which a tool bit is inserted into an axially extending bore in a tool bit holder for receiving and holding different tool bits within said bore, and a probing means for determining the surface configuration of tool bits inserted into the holder for initiating a switching operation, wherein said probing means comprises at least one control element located within said housing in the region of said holder and being selectively displaceable transversely of the bore axis into the bore, a slide located within said housing coaxial with said bore, said slide arranged to abut against said control element in the axial direction of said bore when the control element is displaced laterally outwardly by a tool bit inserted into said holder and to extend axially over said control element when the control element extends radially inwardly of said slide into said bore, said slide having a first part and a second part spaced apart in the axial direction of the bore with said first part arranged to contact said at least one control element and a second part in said second part arranged to initiate the switching operation, said second of said slide comprises a switching member for selectively engaging one gear of a multi-stage gear train for mechanical initiation of the switching operation.

16. A hand-held tool comprises a housing having a front end through which a tool bit is inserted into an axially extending bore in a tool bit holder for receiving and holding different tool bits within said bore, and a probing means for determining the surface configuration of tool bits inserted into the holder for initiating a switching operation, wherein said probing means comprises at least one control element located within said housing in the region of said holder and being selectively displaceable transversely of the bore axis into the bore, a slide located within said housing coaxial with said bore, said slide arranged to abut against said control element in the axial direction of said bore when the control element is displaced laterally outwardly by a tool bit inserted into said holder and to extend axially over said control element when the control element extends radially inwardly of said slide into said bore, said slide having a first part and a second part spaced apart in the axial direction of the bore with said first part arranged to contact said at least one control element and a second part in said second part arranged to initiate the switching operation, said second part of said slide comprises an induction core cooperating with a sensor for producing inductive switching signals for electrical initiation of the switching operation.

17. A hand-held tool, as set forth in claim 15, wherein said control elements are ball-shaped and are supported in radially extending through openings in said holder.

18. A hand-held tool, as set forth in claim 17, wherein said control elements are offset relative to one another in the circumferential direction of said holder.

19. A hand-held tool, as set forth in claim 17, wherein said control elements are arranged to be offset relative to one another in the axial direction of said holder.

20. A hand-held tool, as set forth in claim 18, wherein said control elements are arranged to be offset relative to one another in the axial direction of said holder.

21. A hand-held tool, as set forth in claim 15, wherein said slide is an axially extending sleeve encircling and in contact with the outer surface of said holder, said sleeve has a first end forming said first part of said slide and a second end forming said second part of said slide.

22. A hand-held tool, as set forth in claim 15, wherein a spring element biases said slide into contact with said at least one control element.

23. A hand-held tool, as set forth in claim 21, wherein a spring element biases said slide into contact with said control elements.

24. A hand-held tool, as set forth in claim 15, including a tool bit for insertion into said holder, said tool bit having an axially extending shank arranged to be inserted into said holder and an axially elongated recess formed in said shank for receiving one control element of said probing means.

25. A hand-held tool as set forth in claim 24, wherein said axially elongated recess has a length in the axial direction and said control element is ball-shaped and has a diameter less than the axial length of said recess.

26. A hand-held tool, as set forth in claim 24, wherein a plurality of said recesses are arranged circumferentially around said shank.

27. A hand-held tool, as set forth in claim 26, wherein said axially elongated recesses are offset axially relative to the axial direction of said holder with respect to one another.

* * * * *